US007077629B2

(12) United States Patent
Chen

(10) Patent No.: US 7,077,629 B2
(45) Date of Patent: Jul. 18, 2006

(54) MULTI-FAN ASSEMBLY

(76) Inventor: Chia-Teh Chen, 5FL., No. 30, Yi Shian Rd., Sung Shan Chiu, Taipei (TW)

( * ) Notice: Subject to any disclaimer, the term of this patent is extended or adjusted under 35 U.S.C. 154(b) by 25 days.

(21) Appl. No.: 10/914,435

(22) Filed: Aug. 9, 2004

(65) Prior Publication Data

US 2006/0029498 A1 Feb. 9, 2006

(51) Int. Cl.
*F04D 29/34* (2006.01)

(52) U.S. Cl. ..... 416/99; 416/5; 416/110; 416/123; 416/130; 417/423.5

(58) Field of Classification Search ..... 416/5, 416/99, 110, 111, 120, 123, 130, 170 R; 417/423.5
See application file for complete search history.

(56) References Cited

U.S. PATENT DOCUMENTS 1,270,832 A * 7/1918 Jennings ..... 416/110
1,295,618 A * 2/1919 Shaw ..... 416/110
6,364,638 B1 * 4/2002 Liu ..... 417/423.15
6,722,859 B1 * 4/2004 Chen ..... 417/423.5
6,832,902 B1 * 12/2004 Gajewski et al. ..... 416/5
6,913,443 B1 * 7/2005 Chen ..... 416/99
2003/0082062 A1 * 5/2003 Chen ..... 417/423.5
2003/0210982 A1 * 11/2003 Chen ..... 416/5

* cited by examiner

*Primary Examiner*—Christopher Verdier
(74) *Attorney, Agent, or Firm*—Charles E. Baxley

(57) ABSTRACT

A multi-fan assembly whose revolution speed can be controlled by a member fan designed with a reverse rotating structure, which includes a housing in which is provided a rotatable member; a positive-rotation member fan is equipped with a positive-rotation motor, the positive-rotation motor serves to rotate blade holders and fan blades mounted on the blade holders, the positive-rotation member fan is fixed to the rotatable member via a holding arm; a reverse-rotation member fan is equipped with a reverse-rotation motor, the reverse-rotation motor serves to rotate blade holders and fan blades mounted on the blade holders, the reverse-rotation motor's rotating direction is opposite to that of the positive-rotation motor, the reverse-rotation member fan is fixed to the rotatable member via a holding arm.

5 Claims, 8 Drawing Sheets

MULTI-FAN ASSEMBLY

FIELD OF THE INVENTION

The present invention relates to a multi-fan assembly, and more particularly to a multi-fan assembly whose revolution speed can be controlled by a reverse torsional force generated by a reverse-rotation member fan which is designed with a reversible rotating structure.

DESCRIPTION OF THE PRIOR ARTS

To avoid confusion during the course of this presentation, here are definitions for some words used in following descriptions as below:

Rotation the spinning of fan blades of the member fan rounds its own axis.

Revolution the circular movement of two or more member fans rotating about a common central shaft.

The main characteristic of a multi-fan assembly is that, besides the member fans can rotate to provide cooling air, it also can provide cool air at a full three dimensional circumferential angle through revolution of the member fans. To achieve this effect, a conventional multi-fan assembly is normally provided with two or more member fans at the outside of a rotatable member and then makes the central mounting bracket revolve continuously in a same direction so as to provide cooling air from multi-directions. Existing multi-fan assemblies are generally divided into two types according to different manners of revolution. The first type as shown in FIG. 1*a*, wherein the multi-fan assembly is driven to revolve by the revolving torsional forces generated by unidirectional rotation of the respective member fans. The revolution speed of the multi-fan assembly is in direct proportion to the rotating speed of the member fans, and this is the characteristic of this type multi-fan assembly, the faster the member fans rotate, the faster the revolution speed of the multi-fan assembly will be, and vice versa. Each member fan generates a torsonal force to add to each other to form a final torsional force for driving the revolution. Because of the addition effect, the final torsional force is always more than sufficient for driving the revolution movement particularly at high fan speed. The second type multi-fan assembly, as shown in FIG. 1*b*, uses a syncmotor to revolve the rotatable member unidirectionally by cooperating with a gear cluster. The revolution speed of this type multi-fan assembly is fixed and has nothing to do with the rotating speed of the member fans. These two conventional multi-fan assemblies have their own defects that are to be explained as follows:

Referring to FIG. 1*a*, the first conventional multi-fan assembly is shown and generally includes a housing 11 and two member fans 12. The housing 11 is fixed to the ceiling via a down rod 13. The rotatable member 14 is rotatably mounted on the down rod 13 and located in the housing 11. On the rotatable member 14 is provided a power unit 15, the two member fans 12 are fixed to the outside of the rotatable member 14 via a holding arm 121. The power unit 15 provides power for the member fans 12 and makes them rotate. When the two member fans rotate in the same direction, a torsional force will be produced to revolve the rotatable member 14, and consequently to cause the revolution of the member fans round the down rod 13. To avoid an over great torsional force from being produced during high speed rotation of the member fans and to prevent over revolution speed, the rotatable member 14 is equipped with a braking gear 16 which is engaged with another braking gear 17 on the down rod 13, so as to form a load for limiting the revolution speed. However, this braking device is only useful to the fixed rotating speed, and it doesn't work well when the user needs different rotating speeds, because the friction force of the braking gears 16 and 17 is fixed and unable to change along with the changes of the rotating speed of the member fans 12. If the friction force of the braking device is designed to limit the greater torsional force produced at high rotating speed, the torsional force produced at a low or a medium rotating speed is unable to overcome the friction force of the braking gears 16, 17, and as a result the rotatable member will be unable to revolve. The revolution speed being substantially changeable along with the changes of the rotating speed of the member fans is the characteristic of this conventional multi-fan assembly, however, things go wrong in real practice. When the rotating speed of the member fans 12 is set at 1500 rpm, 1000 rpm and 500 rpm, the corresponding revolution speeds are 100 rpm, 60 rpm and 20 rpm respectively, this is the limit of the optimum condition designed by the engineer that can enable the revolution to occur at all fan speeds (low, medium and high) of the member fans. But in practical consideration, the optimum revolution speed needs to be confined in the range from 2 rpm to 20 rpm, thus the structural design represented by FIG. 1*a* is not ideal.

Referring next to FIG. 1*b*, as mentioned above, this is the second type conventional multi-fan assembly revolved by the syncmotor and the gear cluster, the difference of FIG. 1*b* as compared with FIG. 1*a* is that the second type multi-fan assembly is additionally provided with the syncmotor 18 and the gear cluster 19, and doesn't have the braking device. In operation, the member fans 12 are powered by the power unit 15 and start to rotate, meanwhile, under the control of the syncmotor 18 and the gear cluster 19, the member fans 12 start to revolve about the down rod 13 at a fixed speed. The load of the syncmotor 18 is increased by a disturbance of natural torsional force (which is produced by the rotation of the member fans 12), especially at high rotating speed, the torsional force reaches its greatest value so that vibration and noise will be caused consequently. The structural design in FIG. 1*b* will cost more to manufacture because of the syncmotor and gear cluster added. Furthermore, according to experience, the sysnmotor 18 and the gear cluster 19 are easily worn off and must be replaced regularly, so the maintenance cost is relatively high.

The present invention has arisen to mitigate and/or obviate the afore-described disadvantages of the conventional multi-fan assembly.

SUMMARY OF THE INVENTION

The primary object of the present invention is to provide a multi-fan assembly whose revolution speed can be controlled by a member fan designed with reverse rotating structure; the member fans at both sides of the multi-fan assembly are structurally designed in an opposite manner with an effect to generate two counteracting torsional forces T1 & T2. Thus a net torsional force T(T=T1−T2) will be produced after the two torsional forces of the two different member fans are counteracted with each other and serves as the ultimate revolution driving force for conducting the revolution movement.

Another object of the present invention is to provide a multi-fan assembly whose revolution speed can be controlled by using a member fan with reverse rotating structure without requiring a syncmotor, gear cluster, braking design or such kind of extra devices. Thus, the production cost, the assembling time and the maintenance expense are significantly reduced.

To achieve the above-mentioned objects, the present invention provides a multi-fan assembly whose revolution speed can be controlled by using a member fan with a reverse rotating structure, which comprises:

a housing, in which is provided a rotatable member;

a positive-rotation member fan is equipped with a positive-rotation motor, the positive-rotation motor serves to rotate blade holders and fan blades, the fan blades are mounted on the blade holders, the positive-rotation member fan is fixed to the rotatable member via a holding arm;

a reverse-rotation member fan is equipped with a reverse-rotation motor, the reverse-rotation motor serves to rotate blade holders and fan blades, the fan blades are mounted on the blade holders, the reverse-rotation motor's rotating direction is opposite to that of the positive-rotation motor, the reverse-rotation member fan is fixed to the rotatable member via a holding arm.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 2:
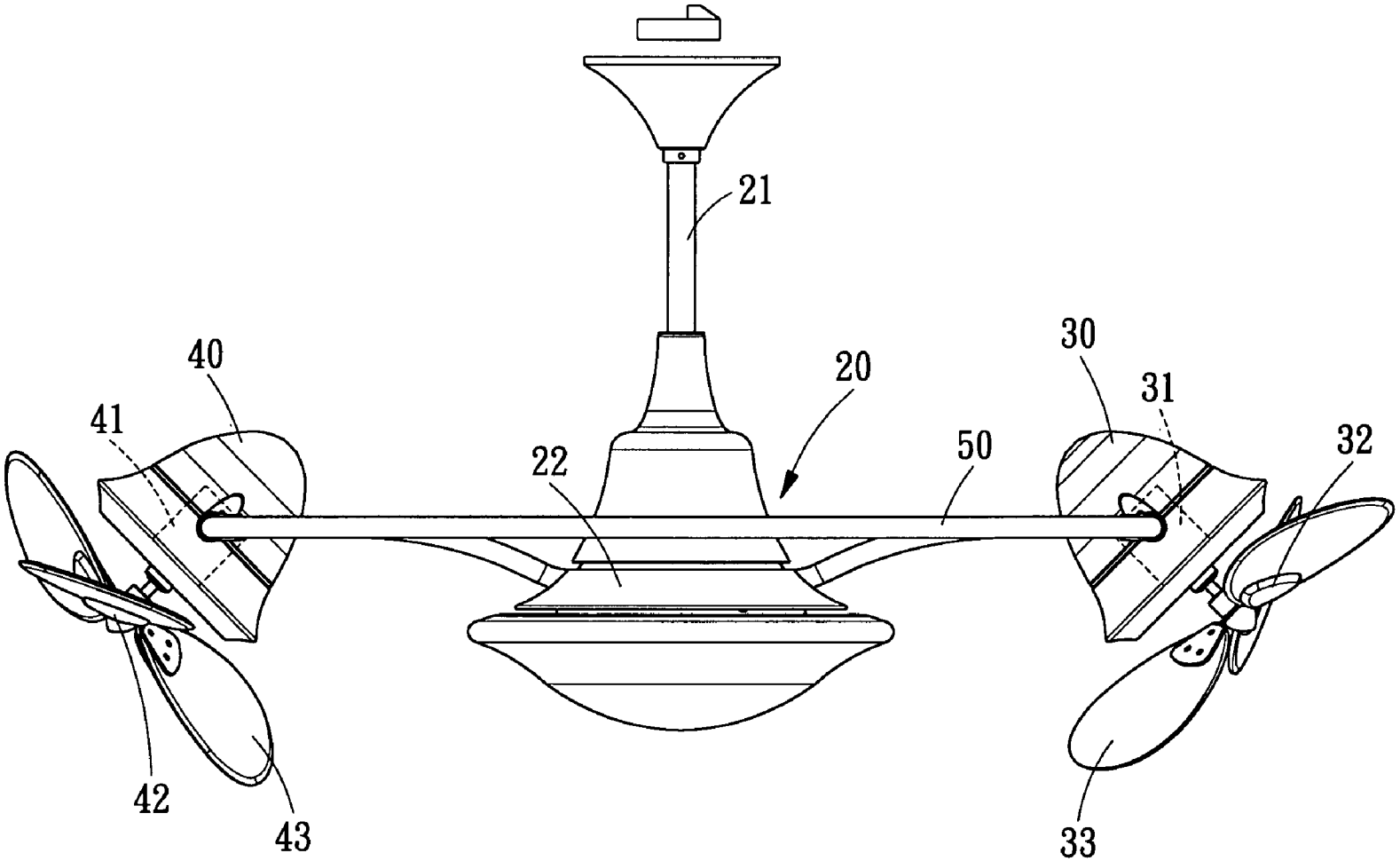
FIG. 2 is a side view of a multi-fan assembly in accordance with a first embodiment of the present invention.

Referring to FIG. 2, a multi-fan assembly in accordance with a first preferred embodiment of the present invention is shown and generally includes: a housing 20, a positive-rotation member fan 30 and a reverse-rotation member fan 40.

The housing 20 is fixed to the ceiling via a down rod 21, and on the down rod 21 is revolvablly provided a rotatable member 22 which is located in the housing 20.

In the positive-rotation member fan 30 is provided a positive-rotation motor 31 whose rotating shaft is equipped with blade holders 32 and fan blades 33, the fan blades 33 are mounted on the blade holders 32. Each of the blade holders 32 is inclined downward from left to right. The positive-rotation member fan 30 is fixed to the rotatable member 22 via a holding arm 50.

In the reverse-rotation member fan 40 is provided a reverse-rotation motor 41 whose rotating shaft is equipped with blade holders 42 and fan blades 43, the fan blades 43 mounted on the blade holders 42. Furthermore, the rotating direction of the reverse-rotation motor 41 is opposite to that of the positive-rotation motor 31, and the blade holders 42 are inclined in an opposite manner to the blade holders 32 (inclined downward from right to left). The reverse-rotation member fan 40 is fixed to the rotatable member 22 via a holding arm 50.

Figure 1A:
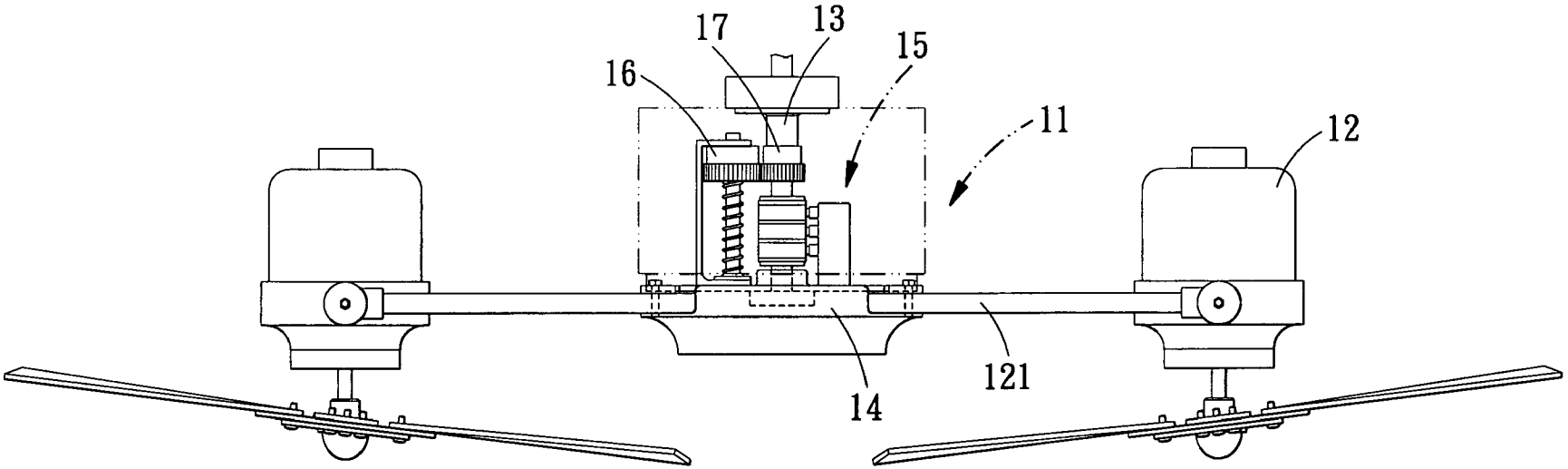
FIG. 1A PRIOR ART
FIG. 1*a* is a partial cross sectional view of a braking device for a conventional multi-rotor ceiling fan.
Figure 1B:
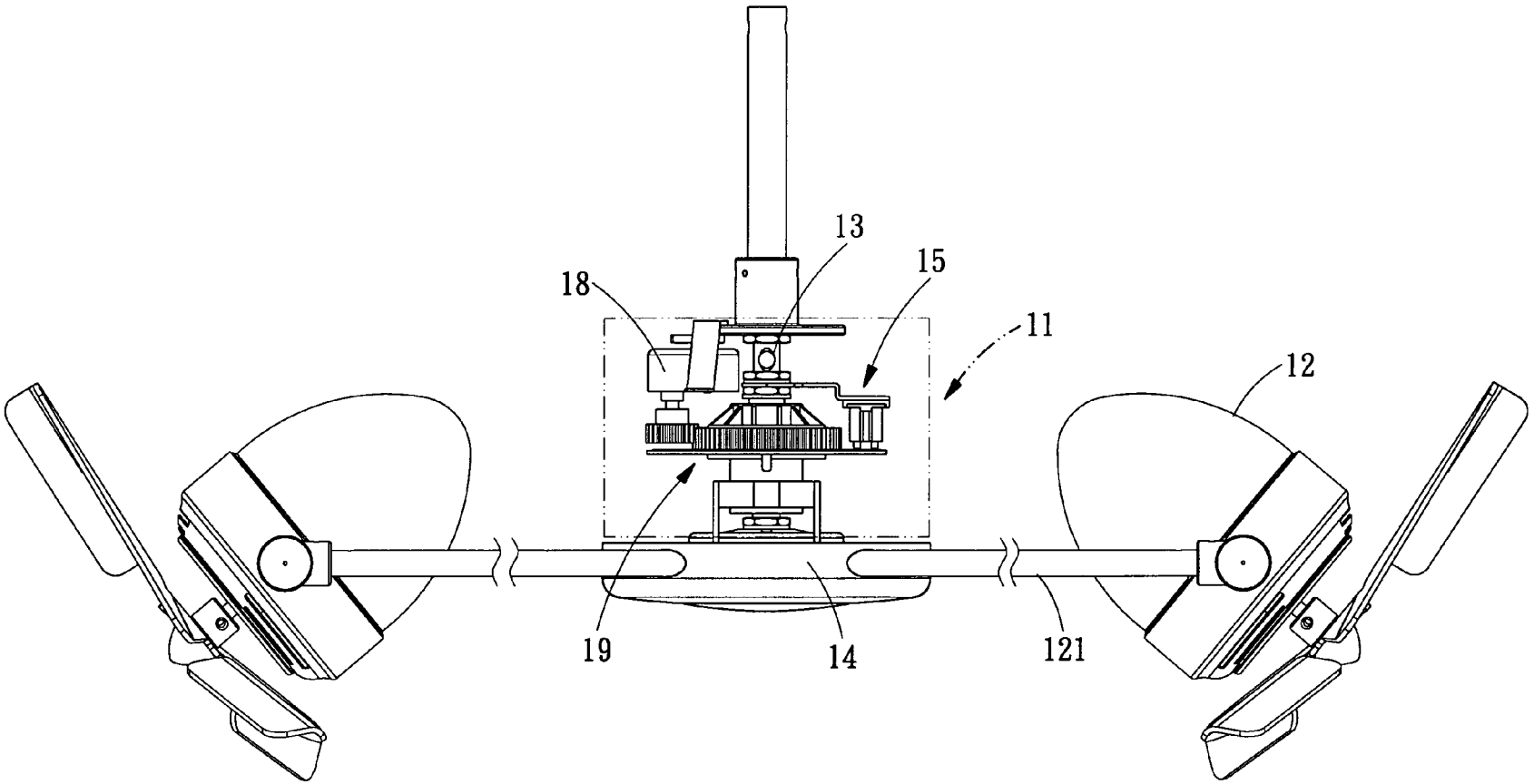
FIG. 1B PRIOR ART
FIG. 1*b* is a partial cross sectional view of a syncmotor and a gear cluster, which are installed in a conventional multi-fan assembly for controlling the revolution speed.
Figure 3:
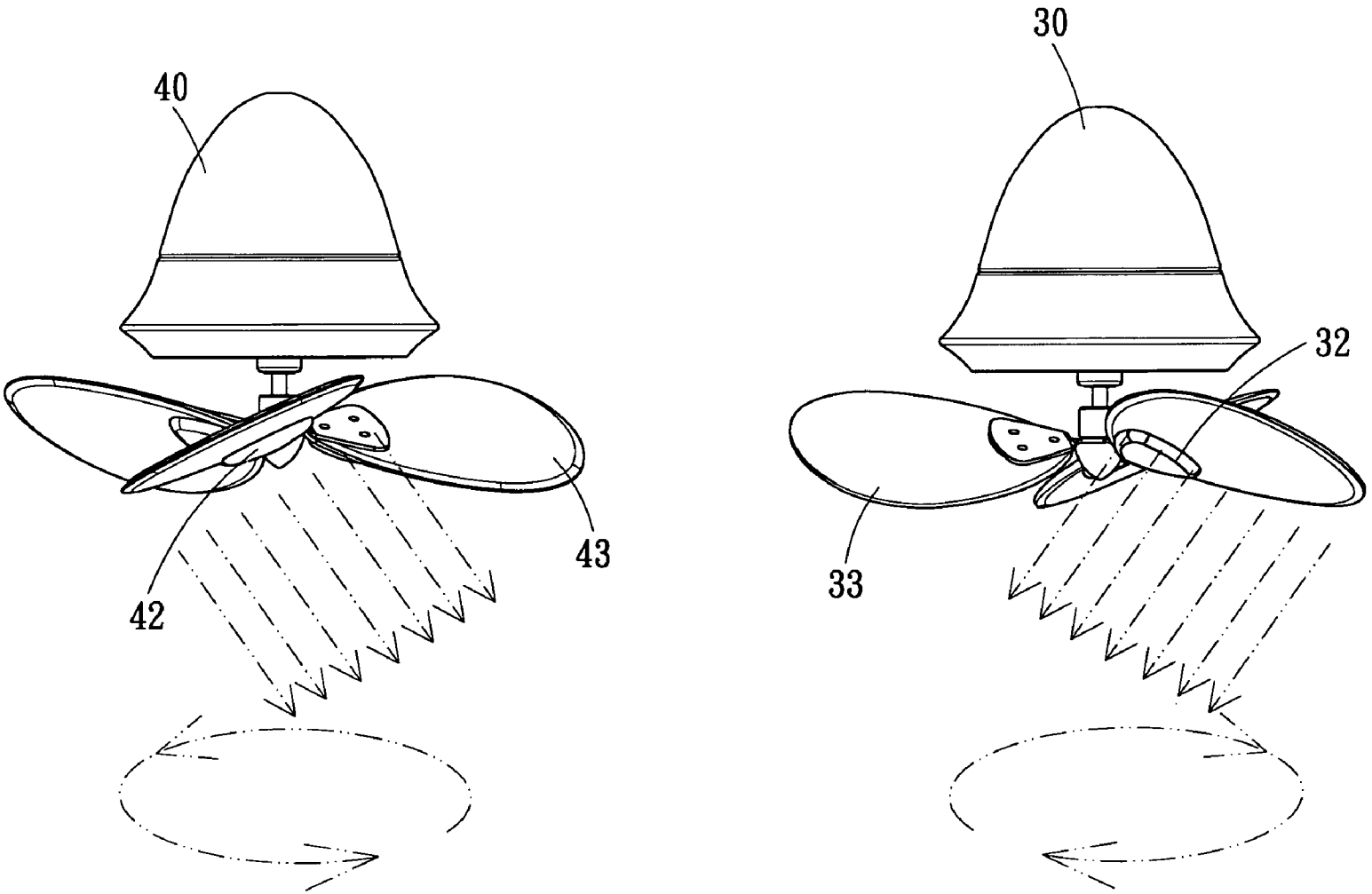
FIG. 3 is a comparative view of the reverse-rotation motor and the positive-rotation motor of the multi-fan assembly in accordance with a first embodiment of the present invention.
Figure 4:
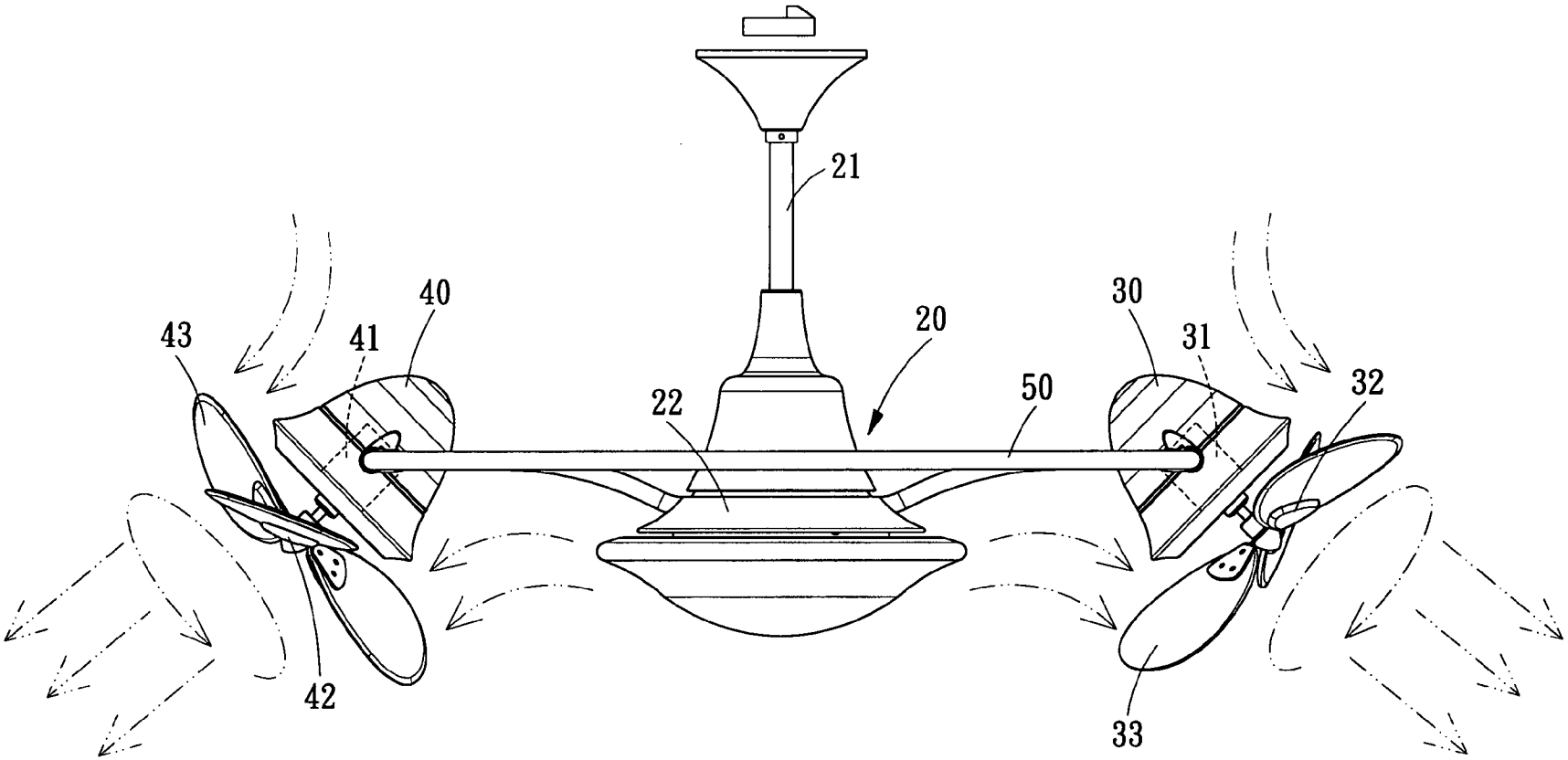
FIG. 4 is an operational view the multi-fan assembly in accordance with a first embodiment of the present invention.

Referring to FIGS. 3 and 4, although the reverse-rotation member fan 40 rotates in a reverse direction, its blade holders 42 are also installed in a reverse manner, thus, reverse-rotation member fan 40 can provide cooling air in a downward direction like the positive-rotation member fan 30 does. The effect of air-circulation of the present invention is different from that of the conventional fan as shown in FIG. 1*a*. In operation, the rotating speed of the positive-rotation motor 31 of the positive-rotation member fan 30 is designed to be greater than that of the reverse-rotation motor 41 of the reverse-rotation member fan 40. And during the revolution of the multi-rotor ceiling fan, since the positive-rotation motor 31 drives the blade holders 32 and the fan blades 33 to rotate clockwise, a positive torsional force T1 will be produced by the positive-rotation member fan 30 in a clockwise direction for driving the positive-rotation member fan 30 and the reverse-rotation member fan 40 to revolve clockwise round the down rod 21. In the same manner, the reverse-rotation motor 41 drives the blade holders 42 and the fan blades 43 to rotate counterclockwise, and a reverse torsional force T2 will be produced by the reverse-rotation member fan 40 in a counterclockwise direction for driving the positive-rotation member fan 30 and the reverse-rotation member fan 40 to revolve counterclockwise round the down rod 21. However, since the rotating speed of the positive-rotation member fan 30 is greater than that of the reverse-rotation member fan 4Q, a net torsional force T will be obtained after the positive torsional force T1 is counteracted by the reverse torsional force T2 (T=T1−T2). The net torsional force T, therefore become the only driving force to activate the revolution of both member fan 30 and member fan 40 round the down rod 21. The revolution speed of the multi-fan assembly can be controlled by differentiating the rotating speed between the member fan 30 and member fan 40. Using such structural design, the present invention is able to control the cooling effect accurately during the revolution of the multi-fan assembly and doesn't require the syncmotor, the gear cluster, the braking design or such kind of extra devices. Thus, the production cost, the assembling time and the maintenance expense are significantly reduced. On the other hand, since the impetus for revolution is the net torsional force which is obtained by subtracting the reverse torsional force from the positive torsional force, it will not be too great just like the prior art (as shown in FIG. 1*a*) whose impetus for revolution is the sum of the torsional force of the respective member fans T=T1+T2. Thereby, the present invention can prevent the occurrence of over speed revolution at high speed and no revolution problem at low or medium fan speed. According to real practice, the revolution speed of the present invention can be reasonably controlled in an ideal range of 2 rpm–20 rpm.

Figure 5:
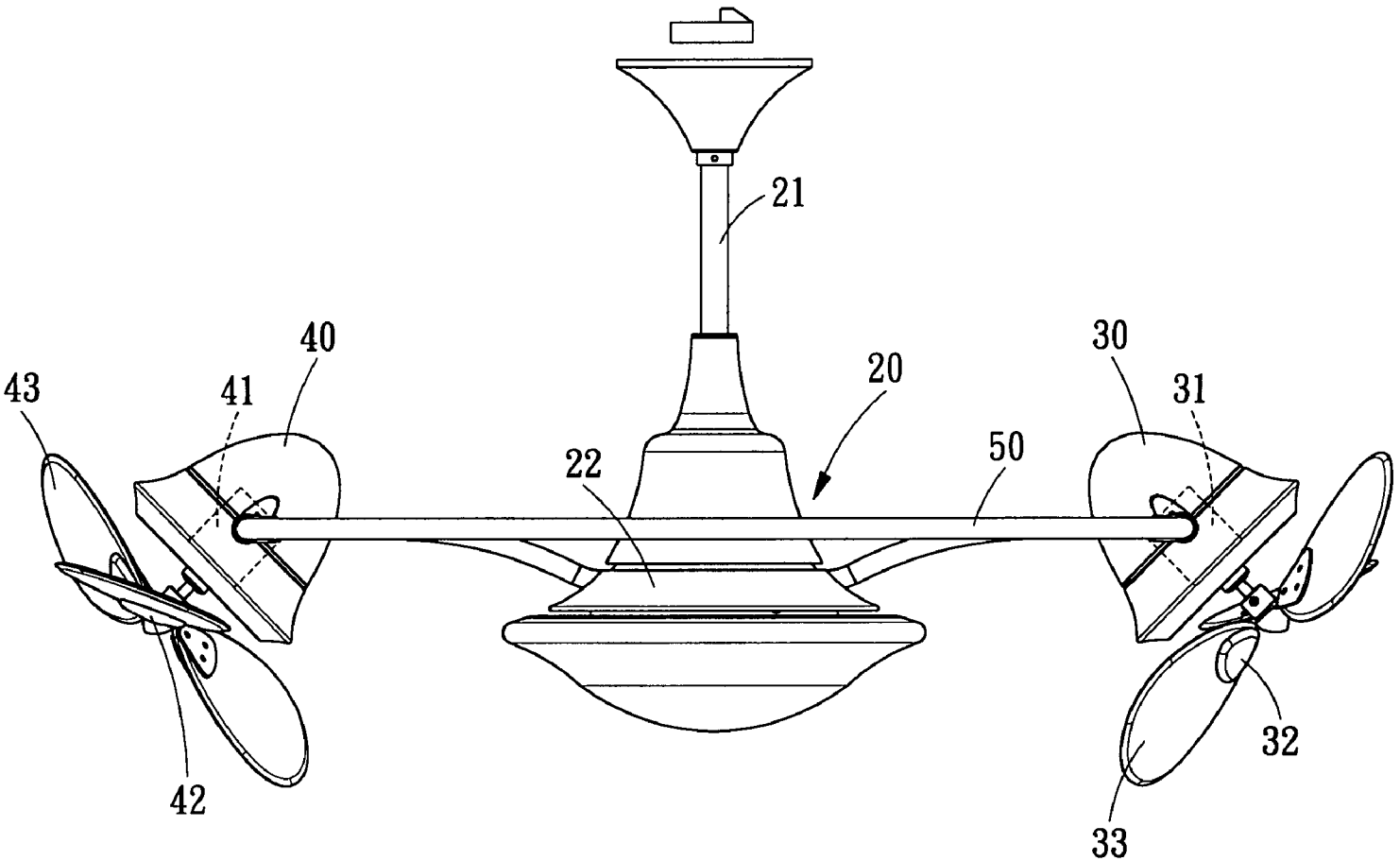
FIG. 5 is a side view of a multi-fan assembly in accordance with a second embodiment of the present invention.

Referring to FIG. 5, a multi-fan assembly in accordance with a second preferred embodiment of the present invention is shown and also includes: a housing 20, a positive-rotation member fan 30 and a reverse-rotation member fan 40. The differences of the second preferred embodiment over the first preferred embodiment are explained as follows:

The positive-rotation motor 31 of the positive-rotation member fan 30 rotates clockwise, and the blade holders 32 are inclined downward from right to left and the fan blades 33 are also inclined in the same manner.

The reverse-rotation motor 41 of the positive-rotation member fan 40 rotates counterclockwise, and the blade holders 42 are inclined in the same manner as the blade holders 32 of the positive-rotation motor 30 (inclined downward from right to left).

Figure 6:
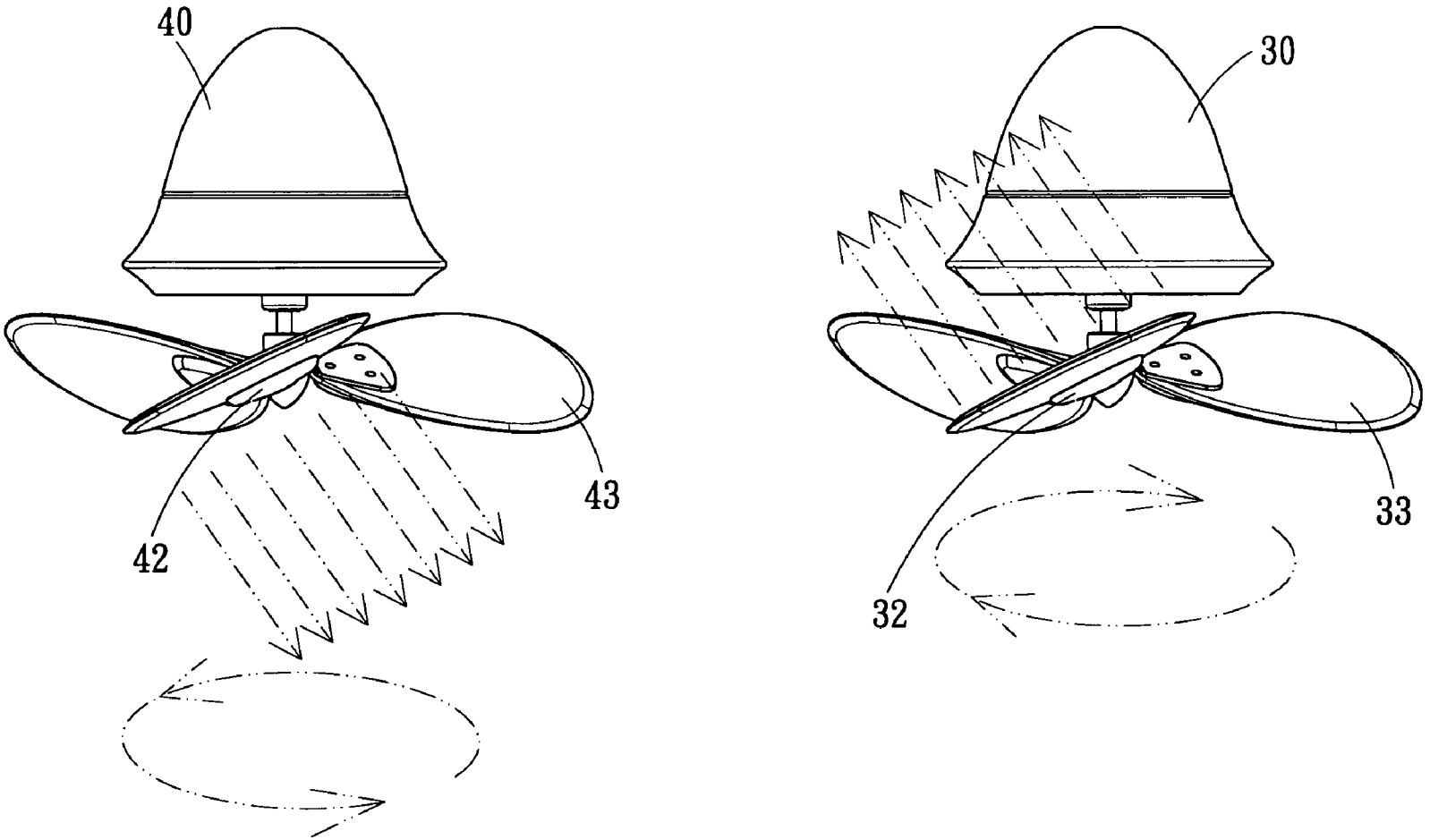
FIG. 6 is a comparative view of the reverse-rotation motor and the positive-rotation motor of the multi-fan assembly in accordance with a second embodiment of the present invention.
Figure 7:
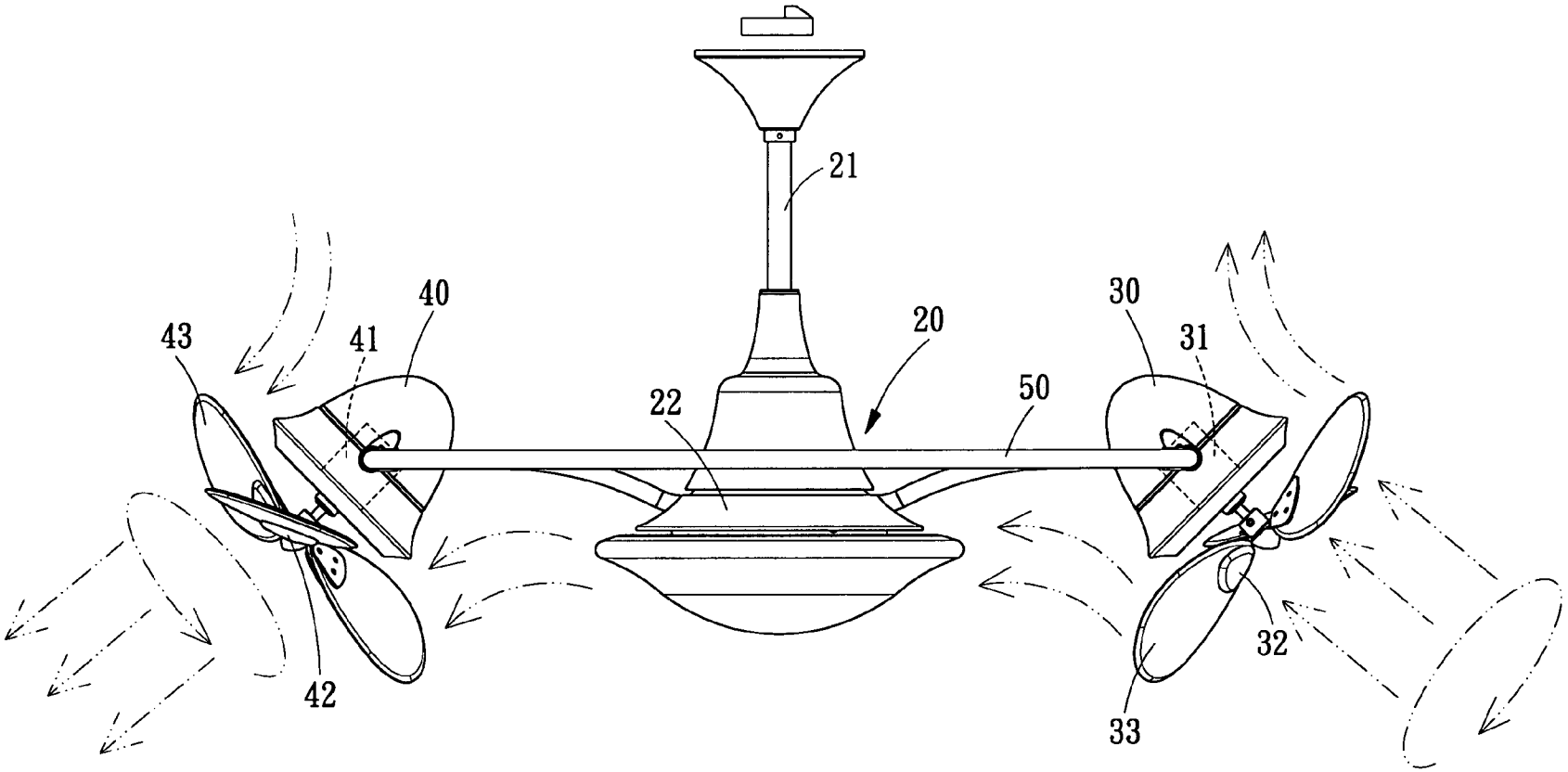
FIG. 7 is an operational view the multi-fan assembly in accordance with a second embodiment of the present invention.

Referring further to FIGS. 6 and 7, since the rotating direction of the reverse-rotation member fan 40 is opposite to that of the positive-rotation member fan 30, the reverse-rotation member fan 40 provides cooling air in a downward direction that is opposite to the positive-rotation member fan 30. The multi-fan assembly of the second embodiment has a special function that the first embodiment is missing. In operation, the positive-rotation member fan 30 rotates to provide cooling air in an upward direction while revolving about the down rod, and the reverse-rotation member fan 40 rotates to draw cooling air in a downward direction while revolving about the down rod. Through such push pull design, the present invention is able to provide not only cool air at a full circumferential angle but also a three dimensional effect of air circulation for warm or cool air in a room. Unlike the conventional ceiling fan which requires users to reverse the switch for circulating warm air in the winter, the present invention can handle both warm air circulation and cooling air circulation at any time without requiring manual adjustment. In terms of revolution-speed control, although the blade holders 32, 42 of the positive and the reverse-rotation member fans 30 and 40 in this embodiment are differently designed as compared with the first embodiment, the torsional force T1 produced by the positive-rotation member fan 30 is still used to make the positive-rotation member fan 30 and the reverse-rotation member 40 revolve about the down rod 21 in a clockwise direction, and alike, the torsional force T2 produced by the reverse-rotation member fan 40 is used to make the positive-rotation member fan 30 and the reverse-rotation member 40 revolve about the down rod21 in a counterclockwise direction. However, since the rotation speed of the positive-rotation member fan 30 is designed to be greater than that of the reverse-rotation member fan 40, a net torsional force T will be produced after the postive torsional force T1 is counteracted by the torsional force T2 (T=T1−T2). The net torsional force T, therefore become the only driving force to activate the revolution of both member fan 30 and member fan 40 round the down rod 21. The function and effect of the multi-fan assembly of this embodiment are the same as the first embodiment; so further remarks on this matter would seem superfluous.

While we have shown and described various embodiments in accordance with the present invention, it should be clear to those skilled in the art that further embodiments may be made without departing from the scope of the present invention.

What is claimed is:

1. A multi-fan assembly comprising:

a housing, in which is provided a rotatable member;

a positive-rotation member fan equipped with a positive-rotation motor serving to rotate blade holders and fan blades, the fan blades mounted on the blade holders of the positive-rotation member fan, the positive-rotation member fan fixed to the rotatable member via a holding arm;

a reverse-rotation member fan equipped with a reverse-rotation motor serving to rotate blade holders and fan blades, the fan blades mounted on the blade holders of the reverse-rotation member fan, wherein the rotating direction of the reverse-rotation motor is opposite to that of the positive-rotation motor, the reverse-rotation member fan fixed to the rotatable member via a holding arm.

2. The multi-fan assembly as claimed in claim 1, wherein the blade holders of the positive-rotation member fan are inclined, and the blade holders of the reverse-rotation member fan are inclined in an opposite manner to the blade holders of the positive-rotation member fan.

3. The multi-fan assembly as claimed in claim 2, wherein the blade holders of the positive-rotation member fan are inclined downward from left to right, and the blade holders of the reverse-rotation member fan are inclined downward from right to left.

4. The multi-fan assembly as claimed in claim 1, wherein the blade holders of the positive-rotation member fan and the blade holders of the reverse-rotation member fan are inclined in the same manner.

5. The multi-fan assembly as claimed in claim 4, wherein the blade holders of the positive-rotation member fan and the blade holders of the reverse-rotation member fan are inclined downward from right to left.

* * * * *